US008427268B2

(12) United States Patent
Feucht et al.

(10) Patent No.: US 8,427,268 B2
(45) Date of Patent: Apr. 23, 2013

(54) ELECTROMAGNETIC VALVE WHICH CAN BE OPERATED WITH DIFFERENT OPERATING VOLTAGES AND METHOD FOR ITS PRODUCTION

(75) Inventors: Thomas Feucht, Wimsheim (DE); Markus Deeg, Eberdingen (DE); Friedbert Roether, Cleebronn (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 354 days.

(21) Appl. No.: 12/391,616

(22) Filed: Feb. 24, 2009

(65) Prior Publication Data

US 2009/0261283 A1 Oct. 22, 2009

Related U.S. Application Data

(63) Continuation of application No. PCT/EP2007/007444, filed on Aug. 24, 2007.

(30) Foreign Application Priority Data

Aug. 25, 2006 (DE) ..... 10 2006 039 945

(51) Int. Cl.
*H01F 27/28* (2006.01)

(52) U.S. Cl.
USPC ..... 336/180

(58) Field of Classification Search ..... 336/208, 336/198, 192, 90, 200, 180–184
See application file for complete search history.

(56) References Cited

U.S. PATENT DOCUMENTS

| | | | | |
|---|---|---|---|---|
| 4,004,185 | A | 1/1977 | Edmondson et al. | |
| 4,615,357 | A * | 10/1986 | Ito | 137/596.17 |
| 5,266,916 | A * | 11/1993 | Kijima | 336/160 |
| 5,887,624 | A * | 3/1999 | Taniguchi et al. | 137/884 |
| 2005/0073795 | A1 * | 4/2005 | Maekawa et al. | 361/160 |
| 2006/0049903 | A1 * | 3/2006 | Wolfgram | 336/180 |

FOREIGN PATENT DOCUMENTS

| | | | |
|---|---|---|---|
| DE | 33 06 324 | A1 | 8/1984 |
| DE | 197 41 570 | A1 | 3/1999 |
| DE | 100 51 433 | A1 | 5/2002 |
| EP | 1 343 180 | A1 | 9/2003 |
| GB | 703990 | | 2/1954 |
| GB | 877601 | A | 9/1961 |
| WO | WO 2004/099682 | A2 | 11/2004 |

OTHER PUBLICATIONS

German Examination Report dated Feb. 2, 2007 w/English translation (six (6) pages).
International Search Report dated Jan. 25, 2008 w/English translation (six (6) pages).

* cited by examiner

*Primary Examiner* — Tuyen Nguyen
(74) *Attorney, Agent, or Firm* — Crowell & Moring LLP

(57) ABSTRACT

An electromagnetic valve is provided with at least one coil containing at least one coil former. The coil former is provided with at least two separate wire windings, of which, in each case, two are connected in series or in parallel with one another.

7 Claims, 1 Drawing Sheet

ELECTROMAGNETIC VALVE WHICH CAN BE OPERATED WITH DIFFERENT OPERATING VOLTAGES AND METHOD FOR ITS PRODUCTION

CROSS-REFERENCE TO RELATED APPLICATIONS

This application is a continuation of PCT International Application No. PCT/EP2007/007444, filed Aug. 24, 2007, which claims priority under 35 U.S.C. §119 to German Patent Application No. DE 10 2006 039 945.5, filed Aug. 25, 2006, the entire disclosures of which are herein expressly incorporated by reference.

BACKGROUND AND SUMMARY OF THE INVENTION

The invention is based on an electromagnetic valve with at least one coil containing at least one coil former.

Electromagnetic coils are used in electromagnetic valves in order to control valve bodies which interact with valve seats using electromagnetic forces. Electromagnetic valves of this type are used, for example, in electronically controlled brake systems (EBS) of utility or commercial vehicles and, as a function of being fed with current, switch or control brake or control pressures.

Depending on the field of use, different operating voltages are applied to these valves. In the case of commercial vehicles used in the United States, an on-board voltage of 12 volts is customary, whereas in Europe this voltage is generally 24 volts. However, with the exception of the different operating voltages, the power data of the 12-volt and 24-volt solenoid valves should be substantially identical.

To date, in each case one integral wire winding with a wire diameter of approximately 0.3 to 0.5 mm and a relatively high number of turns has been used in the coils for 12-volt solenoid valves in order to achieve a required minimum electrical and/or magnetic power. As a result, a coil of this type is relatively large. In order to achieve approximately identical power values, a coil wire with a smaller wire diameter of approximately 0.2 to 0.3 mm is, in contrast, used in the case of the coils for 24-volt solenoid valves, as a result of which the 24-volt coils are approximately 20% smaller than the 12-volt coils. As a result of this, it is necessary to design the respective receptacles for the differently sized coils on otherwise identical solenoid valves with different dimensions, and this increases the outlay on production in a disadvantageous manner.

Furthermore, solenoid valves of this type, which are used in electronically controlled brake systems (EBS), are generally used in so-called pressure control modules as inlet, outlet and back-up valve combinations mounted close to the wheel or axle, where there is usually only a small amount of installation space available. It is therefore necessary for solenoid valves to be as small as possible. This also applies to solenoid valves for other applications, for example, to solenoid valves in transmission control systems.

The invention is based on the object of developing an electromagnetic valve of the above-mentioned type such that it can be operated at different operating voltages without major changes and, at the same time, be as small as possible. A method for producing such a valve is also specified.

According to the invention, an electromagnetic valve has at least one coil containing at least one coil former. The coil former is provided with at least two separate wire windings of which, in each case, two are connected in series or in parallel with one another. Such a coil is produced by providing at least one coil former of the coil with at least two separate wire windings; connecting, in each case, two wire windings in series or in parallel with one another; and providing the electromagnetic valve with the correspondingly connected coil.

The invention is based on the idea that the coil former of the coil of the electromagnetic valve is provided with at least two separate wire windings, of which in each case two are connected in series or in parallel with one another. This coil former contains, for example, only two wire windings which are connected in series or in parallel. Furthermore, a large number of combinations is feasible, for example four wire windings, of which the first and the second wire windings are connected in parallel with one another, the second and the third wire windings are connected in series with one another, and the third and fourth wire windings are again connected in parallel with one another.

In particular, the number of wire windings and the winding parameters of the wire windings, such as the wire diameter and/or number of turns, are selected in such a way that the coil to which predetermined different operating voltages are applied supplies substantially identical electrical and magnetic characteristic variables, such as electrical power and/or magnetic power, as a function of the connection of its wire windings.

For example, a wire which is thinner than that used in the prior art, in particular with a wire diameter which corresponds to that of the wire winding of a coil of a 24-volt solenoid valve, can be used for the wire winding of a coil for a 12-volt solenoid valve. When the wire winding additionally has the same number of turns as in the coil of the 24-volt solenoid valve, assuming the coil formers are the same size, a coil for a 12-volt solenoid valve which is the same size as the coil for a 24-volt solenoid valve is produced, so that the coil holders and, in particular, the coil holes in the valve housings of the electromagnetic valves can be formed with identical geometric dimensions.

Since the rest of the components, apart from the coil, of a 12-volt solenoid valve and a 24-volt solenoid valve should not differ from one another as far as possible, and the switching characteristics in both cases should be as identical as possible, approximately identical electrical variables, for example the electrical power and magnetic power, of the coils in the 12-volt solenoid valve and in the 24-volt solenoid valve are desirable.

This is achieved, according to the invention, in that, for an embodiment as a 12-volt solenoid valve for example, the originally integral wire winding with a thick wire is separated into two separate wire windings of the same size, which wire windings are connected in parallel with one another. In contrast, the two wire windings for the coil of the 24-volt solenoid valve are connected in series. The only difference between a coil for a 12-volt solenoid valve and a coil for a 24-volt solenoid valve is, accordingly, only the respective connection of the two wire windings, this constituting an extremely simple measure in terms of production. The rest of the design of the coils, for example the number of turns, the wire diameter or the coil former, is otherwise identical, this also making it necessary for the coils to have the same physical size.

A method for producing the described electromagnetic valve includes at least the following steps:

a) providing at least one coil former with at least two separate wire windings;

b) connecting in each case two wire windings in series or in parallel with one another as a function of the operating voltage; and c) providing the electromagnetic valve with the correspondingly connected coil.

Accordingly, the invention can be used to produce types of solenoid valves for different operating voltages, but with the same power data, by using a coil which is matched to the respectively required operating voltage only by corresponding connection of the two wire windings and which is otherwise standard, in a similarly standard solenoid valve. This saves on expensive production and storage of different coils and solenoid valves.

The result is a higher electrical power than the prior art given the same installation space for the coil, or a smaller installation space than the prior art given the same power of the coil. This saves, in particular, on copper wire, as a result of which the production costs for the solenoid valves are reduced.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
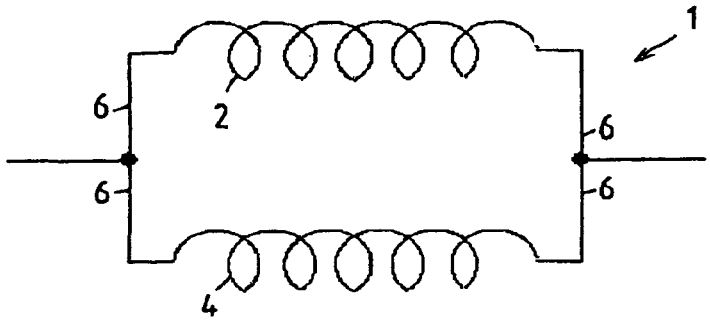
FIG. 1 shows a schematic circuit diagram of a coil for a 12-volt solenoid valve according to a preferred embodiment of the invention.

In FIG. 1, reference numeral 1 indicates a coil of an electromagnetic valve (the rest of which is not shown) as is used, for example, in a pressure control module of an electronically controlled brake apparatus (EBS) of a commercial or utility vehicle. The coil is intended, for example, for a 12-volt solenoid valve, that is to say its operating voltage is 12 volts, since the on-board electrical system of the commercial or utility vehicle is designed for this voltage.

The coil contains, for example, two separate wire windings 2, 4, which are preferably identical with respect to their winding parameters, such as number of turns, wire diameter, wire cross section (round, square) and wire material such as a customary copper wire, and are wound onto a, preferably integral, coil former (not shown here). As an alternative, the coil former could also be of multi-part design, or each wire winding 2, 4 could be assigned to a dedicated coil former.

The ends 6 of the wire windings 2, 4 are conducted out of these wire windings in such a way that the two wire windings 2, 4 can be connected either in series or in parallel with one another. The diameter of the coil wire is, for example, 0.2 mm to 0.3 mm. In the present case of a 12-volt operating voltage, the two wire windings 2, 4 are connected in parallel with one another, for example by the ends 6 which are conducted out of the wire windings 2, 4 being correspondingly connected to one another on a printed circuit board.

Each of the two wire windings 2, 4 has, for example, a resistance of 4 ohms and a number of turns equal to 100, so that the following holds true for the total resistance $R_{tot}$ of the parallel circuit according to FIG. 1:

$$\frac{1}{R_{tot}} = \frac{1}{R1} + \frac{1}{R2} = \frac{1}{4} + \frac{1}{4} = \frac{2}{4}; \Rightarrow R_{tot} = 2\,\text{ohms}$$

The following then holds true for the electrical power of the coil 1:

$$P_{electr} = \frac{U^2}{R_{tot}} = \frac{12^2}{2} = 72\ \text{W/t}$$

and for the magnetic power $$P_{magn} = \frac{U}{R} * N = \frac{12\ \text{V}}{4\,\text{ohms}} * 2 * 100 = 600\frac{\text{V}}{\text{ohm}}$$

Figure 2:
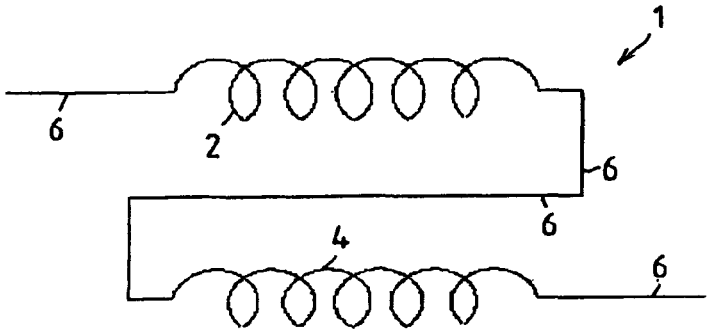
FIG. 2 shows a schematic circuit diagram of the coil from FIG. 1 designed for a 24-volt solenoid valve.

If the same coil 1 is intended to be used for an operating voltage of 24 volts and the power data is intended to be identical, the ends 6 of the wire windings 2, 4 are connected to one another on the printed circuit board in such a way that the two wire windings 2, 4 are connected in series, as is shown in FIG. 2. The following then holds true for the total resistance $R_{tot}$:

$$R_{tot}=R_1+R_2=4+4=8\ \text{ohms}$$

The following then holds true for the electrical power of the coil 1:

$$P_{electr} = \frac{U^2}{R_{tot}} = \frac{24^2}{8} = 72\ \text{W/t}$$

and for the magnetic power:

$$P_{magn} = \frac{U}{R} * N = \frac{24\ \text{V}}{8\ \text{ohms}} * 200 = 600\frac{\text{V}}{\text{ohm}}$$

Consequently, the coil 1 has, under different operating voltages, in this case 12 volts and 24 volts for example, and with parallel connection and series connection of its two wire windings 2, 4, substantially identical electrical characteristic variables, such as electrical power and/or magnetic power, and therefore forms a standard unit for use in solenoid valves with operating voltages of 12 volts and 24 volts. The coil holders of a 12-volt solenoid valve and of a 24-volt solenoid valve, which are generally formed in each case by a coil hole in the valve housing, can then also have identical dimensions. As a result, a 12-volt or 24-volt solenoid valve of this type again forms a standard unit since the rest of the components of the 12-volt solenoid valve and of the 24-volt solenoid valve, apart from the connection of the wire windings 2, 4 of the coil 1, do not differ from one another.

The invention is not restricted to the exemplary embodiment with two separate wire windings 2, 4 on the coil former. Rather, more than two separate wire windings, which can also have different winding parameters, such as the number of turns, wire diameter etc., can be provided as a function of the respectively predefined operating voltages. The number of individual wire windings and connection of the individual wire windings and their winding parameters are adapted by a person skilled in the art on a case-by-case basis as a function of the required electrical and magnetic performance and, in particular, of the predefined operating voltages.

Figure 3:
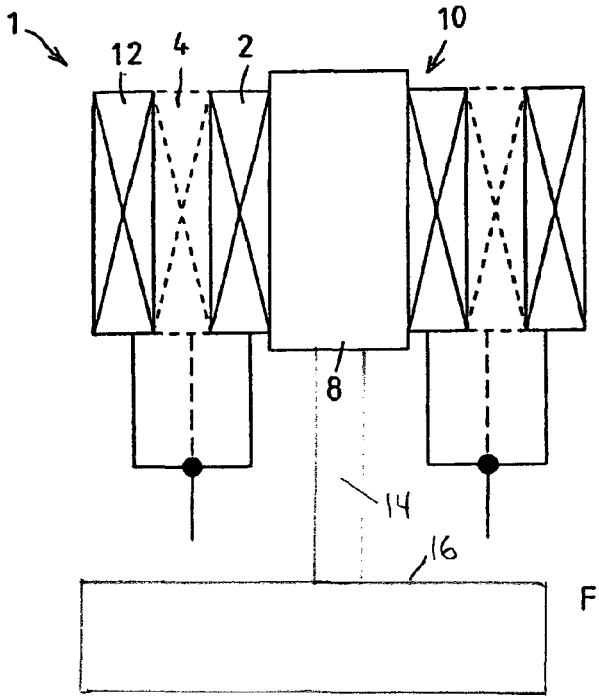
FIG. 3 shows a schematic sectional illustration of a further embodiment of a coil for a solenoid valve according to the invention.

Particular preference is given to the wire windings being wound one over the other on the coil former 10, as disclosed by FIG. 3. In that figure, a first wire winding 2 is wound onto the coil former 10, which surrounds a coil core 8, as the innermost layer (coil core 8 receiving a rod 14 in this embodiment which is moved by the coil to actuate schematically-illustrated electromagnetic valve 16). A second wire winding 4 is wound around this first wire winding 2 in turn, and a third wire winding 12 is, in turn, wound around the second wire winding.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An electromagnetic valve, comprising:

at least one coil containing at least one coil former; and at least two separate wire windings provided for the coil former, the two separate wire windings being operably configured to permit selective wiring in series or in parallel with one another during manufacture of the valve, wherein a number of wire windings and winding parameters of the wire windings are selected such that the coil supplies substantially identical electrical and magnetic characteristic variables when the wire windings are connected in series and a first voltage is applied and when the wire windings are connected in parallel and a second voltage is applied.

2. The electromagnetic valve according to claim 1, wherein the winding parameters include one or more of: wire diameter, number of turns, and wire cross-section; and said electrical and magnetic characteristic variables include one or more of: electrical power and magnetic power.

3. The electromagnetic valve according to claim 1, wherein the at least two separate wire windings have a same number of turns.

4. The electromagnetic valve according to claim 1, wherein the at least two separate wire windings have a same wire diameter and wire cross-section.

5. The electromagnetic valve according to claim 3, wherein the at least two separate wire windings have a same wire diameter and wire cross-section.

6. A method for producing an electromagnetic valve, the method comprising the acts of:

providing at least one coil former of at least one electromagnetic coil with at least two separate wire windings;

connecting, in each case, the two separate wire windings in series or in parallel with one another;

arranging the connected wire windings of the at least one electromagnetic coil in a receptacle of the electromagnetic valve, and selecting a number of wire windings and winding parameters of the wire windings such that said coil supplies substantially identical electrical and magnetic characteristics variables when the wire windings are connected in series and a first voltage is applied and when the wire windings are connected in parallel and a second voltage is applied.

7. The method according to claim 6, wherein the winding parameters include at least one of: wire diameter, number of turns, and wire cross-section; and the characteristic variables include at least one of electrical power and magnetic power.

* * * * *